US006795084B2

(12) United States Patent
Newman

(10) Patent No.: US 6,795,084 B2
(45) Date of Patent: Sep. 21, 2004

(54) HEURISTIC DETERMINATION OF COLOR REPRODUCTION PARAMETERS

(75) Inventor: Todd Newman, Palo Alto, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 10/032,500

(22) Filed: Jan. 2, 2002

(65) Prior Publication Data

US 2003/0122842 A1 Jul. 3, 2003

(51) Int. Cl.[7] ..... G09G 5/02

(52) U.S. Cl. ..... 345/589; 345/690; 345/102; 345/88; 358/1.9; 358/500

(58) Field of Search ..... 345/690, 102, 345/88, 589; 358/1.9, 500

(56) References Cited

U.S. PATENT DOCUMENTS

| | | | | | |
|---|---|---|---|---|---|
| 4,270,284 | A | * | 6/1981 | Skellings | 434/156 |
| 5,167,504 | A | * | 12/1992 | Mann | 434/157 |
| 5,208,911 | A | | 5/1993 | Newman et al. | 395/162 |
| 5,432,906 | A | | 7/1995 | Newman et al. | 395/162 |
| 5,446,476 | A | | 8/1995 | Kouzaki | 347/232 |
| 5,463,480 | A | | 10/1995 | MacDonald et al. | 385/520 |
| 5,532,848 | A | | 7/1996 | Beretta | 358/504 |
| 5,896,468 | A | | 4/1999 | Kowalski | 382/264 |
| 5,956,015 | A | * | 9/1999 | Hino | 345/600 |
| 5,966,540 | A | | 10/1999 | Lister et al. | 395/712 |
| 5,986,654 | A | * | 11/1999 | Alexander et al. | 345/744 |
| 6,006,035 | A | | 12/1999 | Nabahi | 395/712 |
| 6,059,842 | A | | 5/2000 | Dumarot et al. | 717/11 |
| 6,108,095 | A | | 8/2000 | Graf | 356/425 |
| 6,192,341 | B1 | | 2/2001 | Becker et al. | 704/271 |
| 6,211,891 | B1 | | 4/2001 | Wahlig | 345/521 |
| 6,266,811 | B1 | | 7/2001 | Nabahi | 717/11 |
| 6,282,712 | B1 | | 8/2001 | Davis et al. | 717/11 |
| 6,300,931 | B1 | * | 10/2001 | Someya et al. | 345/102 |
| 6,587,116 | B1 | * | 7/2003 | Hendry et al. | 345/600 |
| 6,606,407 | B1 | * | 8/2003 | Takahashi et al. | 382/164 |
| 2002/0051145 | A1 | * | 5/2002 | Watanabe et al. | 358/1.9 |
| 2002/0089514 | A1 | * | 7/2002 | Kitahara et al. | 345/600 |
| 2003/0026608 | A1 | * | 2/2003 | Malloy Desormeaux | 396/281 |
| 2003/0081255 | A1 | * | 5/2003 | Shimizu | 358/2.1 |

FOREIGN PATENT DOCUMENTS

| | | |
|---|---|---|
| EP | 0983863 | 3/2000 |

OTHER PUBLICATIONS

Corel Wordperfect, 1996, version 6.1for windows.*
Bartleson, C.J., "Some Observances on the Reproduction of Flesh Colors," Phot. Sci. Eng. vol. 3 (1959), pp. 114–117.
Yano, T. et al., Preference for Japanese Complexion Color under illumination in AIC Color '97, pp. 823–826.

* cited by examiner

*Primary Examiner*—Matthew C. Bella
*Assistant Examiner*—Manucher Rahmjoo
(74) *Attorney, Agent, or Firm*—Fitzpatrick, Cella, Harper & Scinto

(57) ABSTRACT

Color reproduction method in a computerized image forming apparatus, which comprises performing heuristic analysis of the configuration of the apparatus in order to infer color environment of the apparatus, and automatically setting color reproduction parameters of the computerized image forming apparatus based on the color environment of the apparatus. The color environment includes color perceptions and color preferences of the user of the apparatus as well as the viewing condition at the apparatus. The configuration of the apparatus may include the type and class of user installed software, language setting of the user interface, and the time zone setting. The user has the option of overriding the heuristically determined factors by manually entering them through a user interface.

21 Claims, 5 Drawing Sheets

HEURISTIC DETERMINATION OF COLOR REPRODUCTION PARAMETERS

BACKGROUND OF THE INVENTION

1. Field of the Invention

The present invention relates to color reproduction methods in computerized image forming apparatus, and in particular to heuristic analysis of a computerized image forming apparatus for automatic determination of color reproduction parameters.

2. Description of the Related Art

It is well known that a variety of factors affect people's perceptions of a color image and their preferred color reproduction of that image. For example, the lighting condition under which an image is viewed dramatically affects its color appearance. Therefore color appearance models typically include parameters such as background, surround, and ambient illumination level, in addition to a reference white point, in order to accurately account for the viewing conditions. Cultural factors also affect a viewer's color perceptions and color reproduction preferences. For example, a color image which makes a favorable impression on a Japanese viewer may be considered too reddish and have a higher saturation level than that favored by a European viewer. Therefore the Japanese and European viewers are likely to prefer different color reproductions of the same image.

Prior art in this area has provided for adjustment of color reproduction parameters based on manual entry by the user of certain factors such as lighting conditions, the region where the color reproduction is being executed, the color of the viewer's eyes, and the season or date when the image is observed, through a user interface. The color reproduction parameters of the apparatus are then automatically adjusted in response to these entries in order to reproduce a more appealing color to the viewer.

The problem is that an ordinary user of a consumer product is unlikely to manually enter such data or to understand how it affects the adjustment of color reproduction parameters. This may be due to a number of factors such as the user's level of sophistication, cumbersomeness of the interface, or a desire for simplicity.

SUMMARY OF THE INVENTION

It is an object of the present invention to provide for automatic determination of color reproduction parameters of a computerized image forming apparatus that is based on heuristic analysis of the configuration of the image forming apparatus itself.

According to one aspect of color reproduction in accordance with the present invention, the configuration of a computerized image forming apparatus is analyzed through heuristic analysis in order to infer color environment of the apparatus such as color preference information about the user of the apparatus or information about the viewing condition for images produced by the apparatus. Color reproduction parameters on the computerized image forming apparatus are then automatically adjusted in accordance with the color environment.

Heuristic analysis, as used here, describes a probabilistic approach by which a color environment is inferred based on probabilities rather than certainties. Examples of heuristic analysis include expert systems, fuzzy logic, neural networks and artificial intelligence.

Configurations subjected to heuristic analysis include language of the installed software, time zone settings, installed device drivers for hardware, and other specific information available from the software configuration of the apparatus. This information will help determine the likely region (Asia, Europe, North America, Africa, etc.) where the reproduced image will be viewed. Determination of the likely viewing region will in turn provide an educated guess as to the color perception and color reproduction preferences of a viewer of a reproduced image.

Configurations subjected to heuristic analysis also include the class and type of the software installed on the apparatus. For example, presence of high-end graphic arts software on the computer is likely indicative of a graphics arts lighting environment. Determination of the lighting environment will, in turn, determine lighting condition (natural light, incandescent lamp, fluorescent lamp, etc.) under which the reproduced color will likely be viewed.

These and other configurations, including the price of the apparatus, the class of the device, and any other information that can be determined by inspection of the configuration of the apparatus, are then used to automatically determine color reproduction parameters for the apparatus.

Because the invention utilizes heuristics to determine the color environment and thereafter automatically sets color reproduction parameters on the computerized image forming apparatus in accordance with that determination, it provides the user with an improved color image reproduction without requiring the user to determine color reproduction parameters and to enter these parameters into the computer image forming apparatus.

An additional aspect of the invention is that the heuristically determined color reproduction parameters can be overridden by the user by manual entry of the information on the computerized image forming apparatus through a user interface. This will accommodate viewers that have different color preferences than those heuristically determined, and viewing environments that are different than those determined based on the heuristic analysis due to, for example, physical relocation of the apparatus.

This brief summary has been provided so that the nature of the invention may be understood quickly. A more complete understanding of the invention can be obtained by reference to the following detailed description of a preferred embodiment thereof in connection with the attached drawings.

DETAILED DESCRIPTION OF PREFERRED EMBODIMENTS

Figure 1:
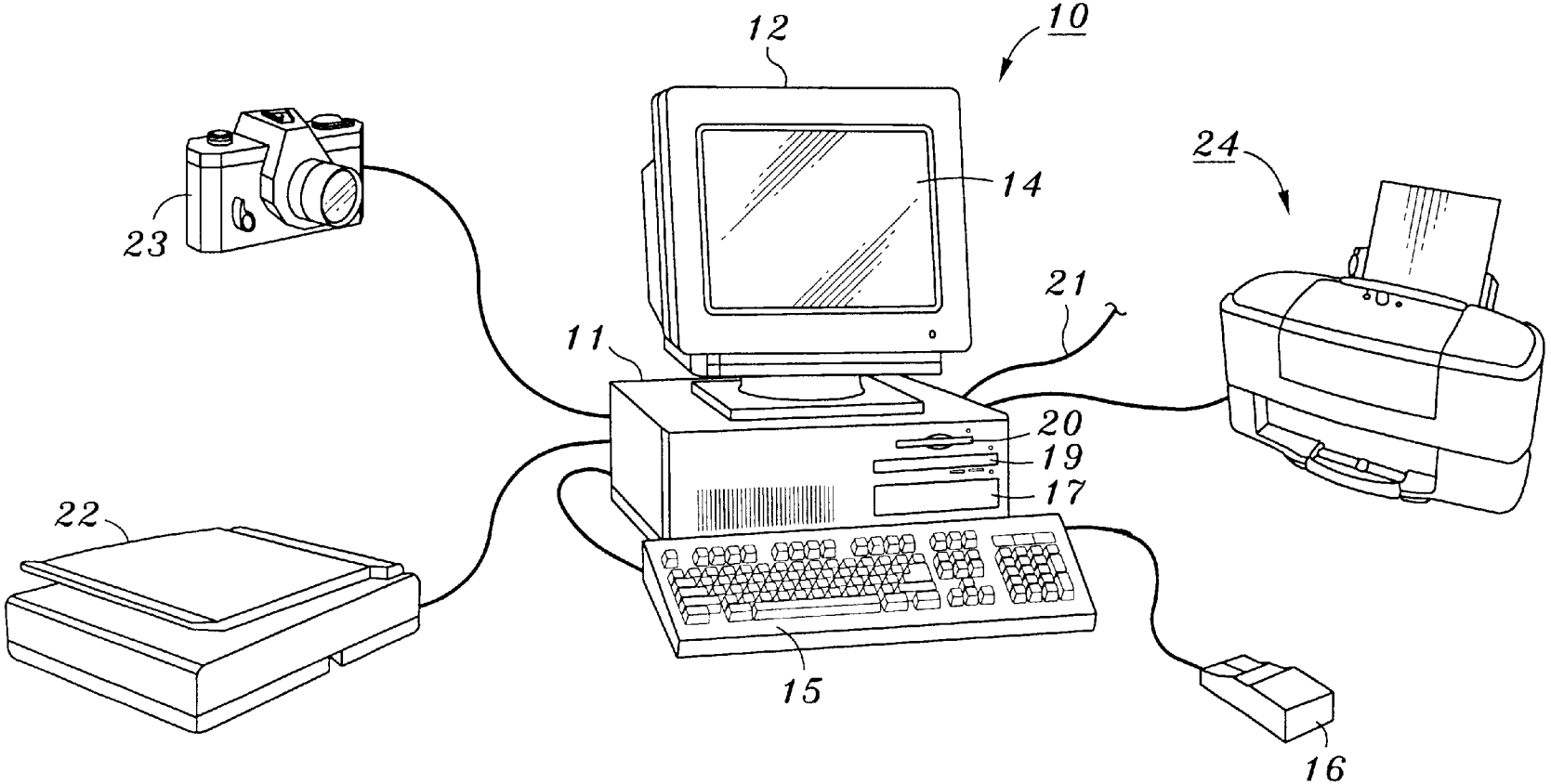
FIG. 1 is a view illustrating the outward appearance of a representative embodiment of the invention.

FIG. 1 is a view showing the outward appearance of a representative embodiment of the invention. Computing equipment 10 includes host processor 11 comprising a personal computer (hereinafter "PC") preferably having a windowing operating system such as Microsoft Windows, Xwindows or MacIntosh operating systems. Provided with the computing equipment 10 are color monitor 12 including display screen 14, keyboard 15 for entering text data and user commands, and pointing device 16. Pointing device 16 preferably comprises a mouse, for pointing, selecting and manipulating objects displayed on display screen 14.

Computing equipment 10 includes a computer-readable memory medium such as a fixed disk 17 and/or floppy disk drive 19 and/or CD-ROM drive 20. Such computer readable memory media allow computing equipment 10 to access information such as image data, computer executable process steps, application programs, and the like, stored on removable and non-removable memory media. In addition, network access 21 allows computing equipment 10 to acquire information, images and application programs from other sources, such as a local area network or the Internet, or from digital cameras or digital video cameras.

Scanner 22 scans original images such as original color photographs or color documents to provide image information to computing equipment 10. Image capture device 23 such as a digital camera or digital video camera captures original images and transmits them to computing equipment 10. Printer 24 is a color output device such as an ink jet printer or a color laser beam printer.

Figure 2:
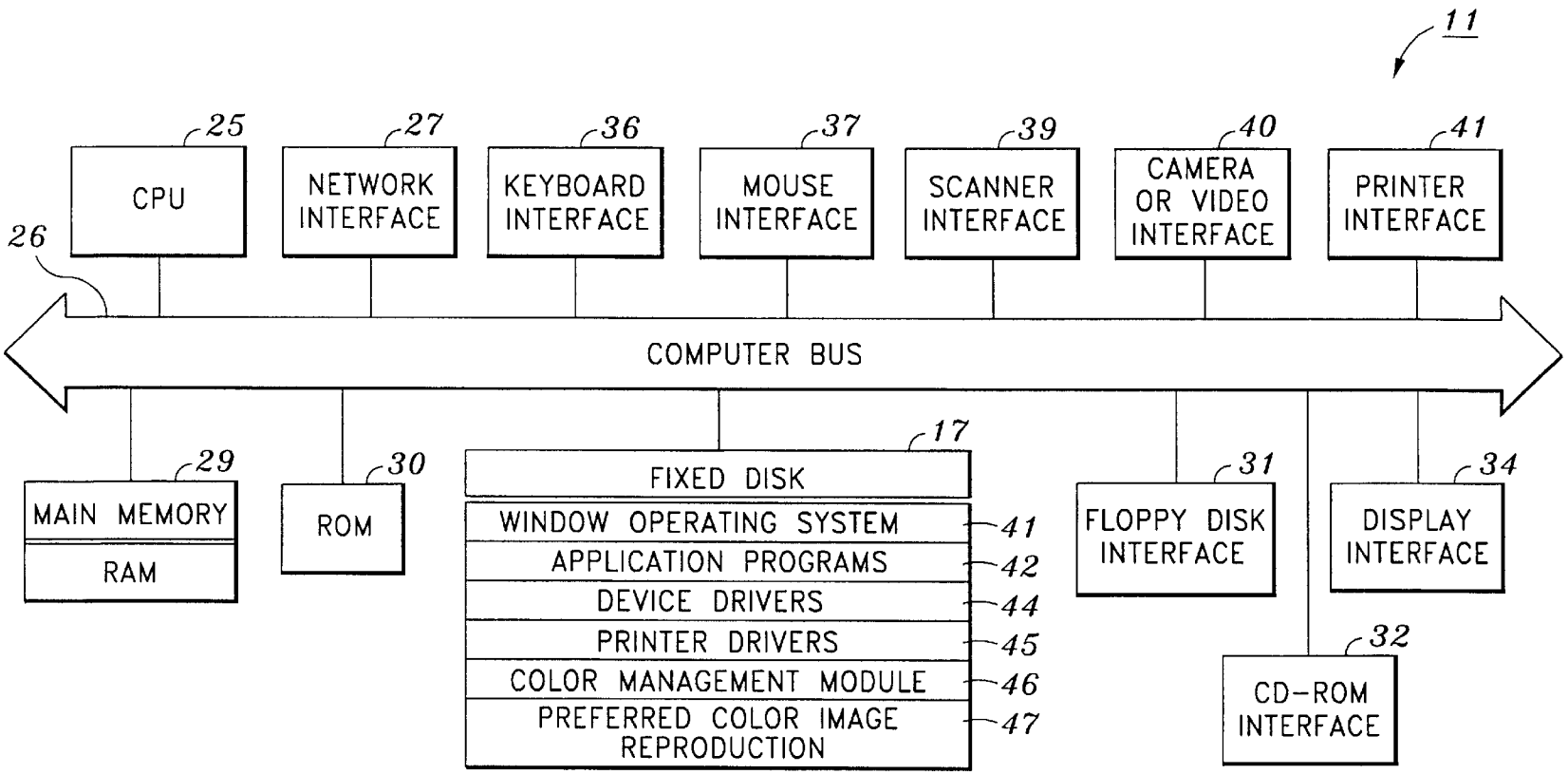
FIG. 2 is a detailed block diagram of the computing equipment shown in FIG. 1.

FIG. 2 is a detailed block diagram showing the internal architecture of PC 11. As shown in FIG. 2, PC 11 includes central processing unit ("CPU") 25 that interfaces with computer bus 26. Also interfacing with computer bus 26 are fixed disk 17, network interface 27 for network access 21, random access memory ("RAM") 29 for use as main memory, read only memory ("ROM") 30, floppy disk interface 31, CD-ROM interface 32, display interface 34 to monitor 12, keyboard interface 36 to keyboard 15, mouse interface 37 to pointing device 16, scanner interface 39 to scanner 22, digital camera interface 40 to digital camera 23, and printer interface 41 to printer 24.

Main memory 29 interfaces with computer bus 26 so as to provide RAM storage to CPU 25 during execution of software programs such as the operating system, application programs, and device drivers. More specifically, CPU 25 loads computer-executable process steps from disk 17 or other memory media into a region of main memory 29, and thereafter executes the stored process steps from main memory 29 in order to execute software programs. Data such as color images can be stored in main memory 29, where the data can be accessed by CPU 25 during execution.

As also shown in FIG. 2, fixed disk 17 contains a window operating system 41, application programs 42 such as application programs that manipulate, obtain and print color images, device drivers 44 such as printer driver 45, and color management module 46 for color image reproduction in accordance with the invention.

Color image reproduction according to the invention is preferably implemented according to a color management system that includes a color management module such as that shown at 46. Color management module 46 may be implemented as a stand-alone software application program, but more preferably is implemented as part of an output device driver such as printer driver 45. It is also possible to implement a color management module, which includes the preferred color image reproduction according to the invention, as a dynamic link library ("DLL"), or as a plug-in to other application programs such as image manipulation programs like Adobe Photoshop.

Figure 3:
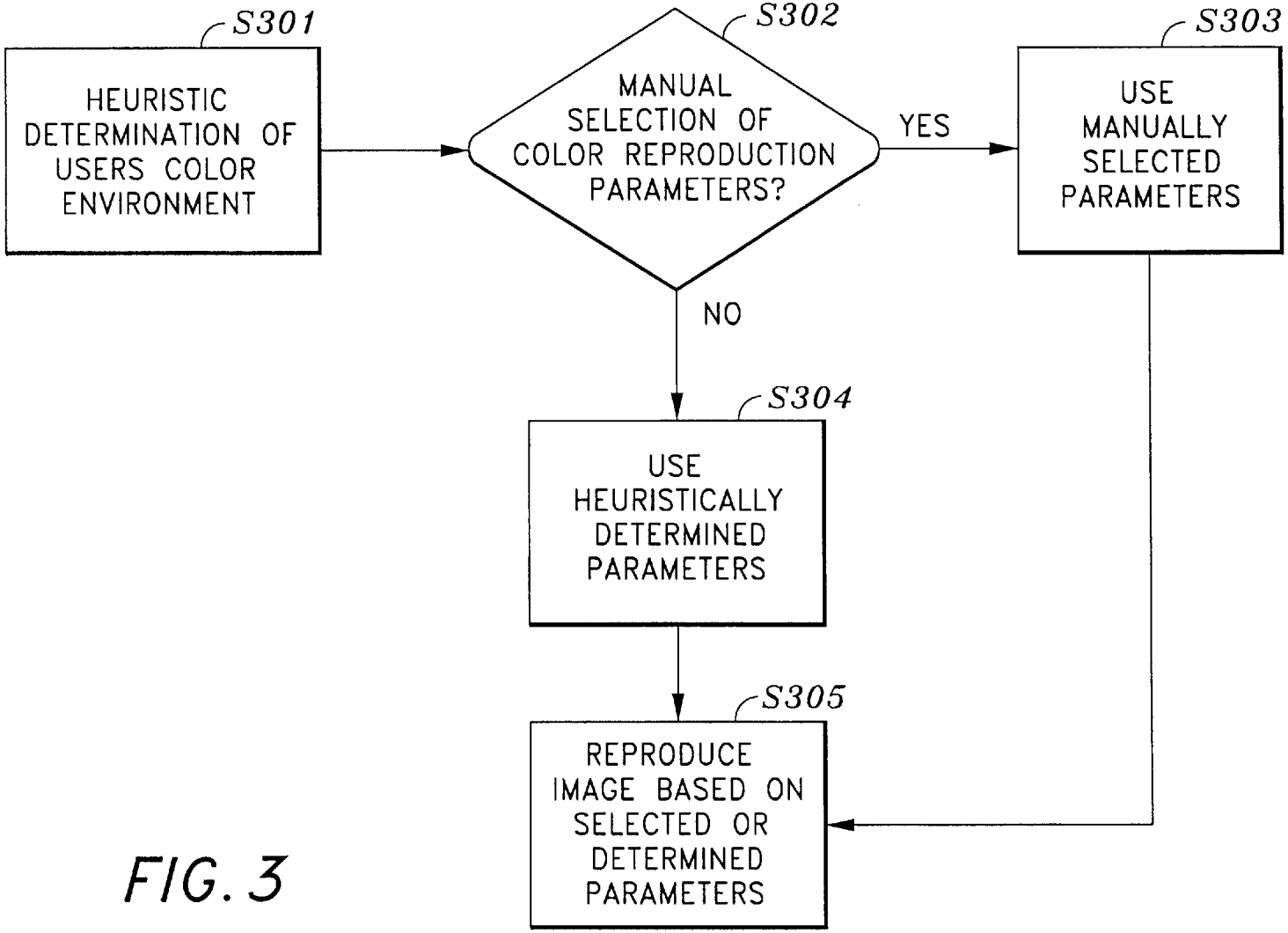
FIG. 3 is a flow diagram explaining operation of the invention.

FIG. 3 is a flow diagram for explaining operation of the invention. Briefly, according to FIG. 3, user's color environment is inferred by performing heuristic analysis of configuration of a computerized image forming apparatus. Color reproduction parameters of the apparatus are then set automatically based on the inferred color environment.

In more detail, The user's color environment is heuristically determined in step S301. Color environment is defined here as including color reproduction preferences and/or the viewing environment of the reproduced image. Heuristics are explained in FIG. 4. As shown in step S302, preferred embodiment provides a user with the option of overriding the heuristically determined color reproduction parameters by manually entering those parameters through a user interface. Where the user takes advantage of this option as shown in step S303, the manually entered parameters are used in determining color reproduction parameters as shown in step S305. In the absence of user entry of these parameters, the invention uses the heuristically determined parameters obtained through step S304 for reproduction of the image as shown in step S305. The image reproduction step S305 is shown in FIG. 5.

Figure 4:
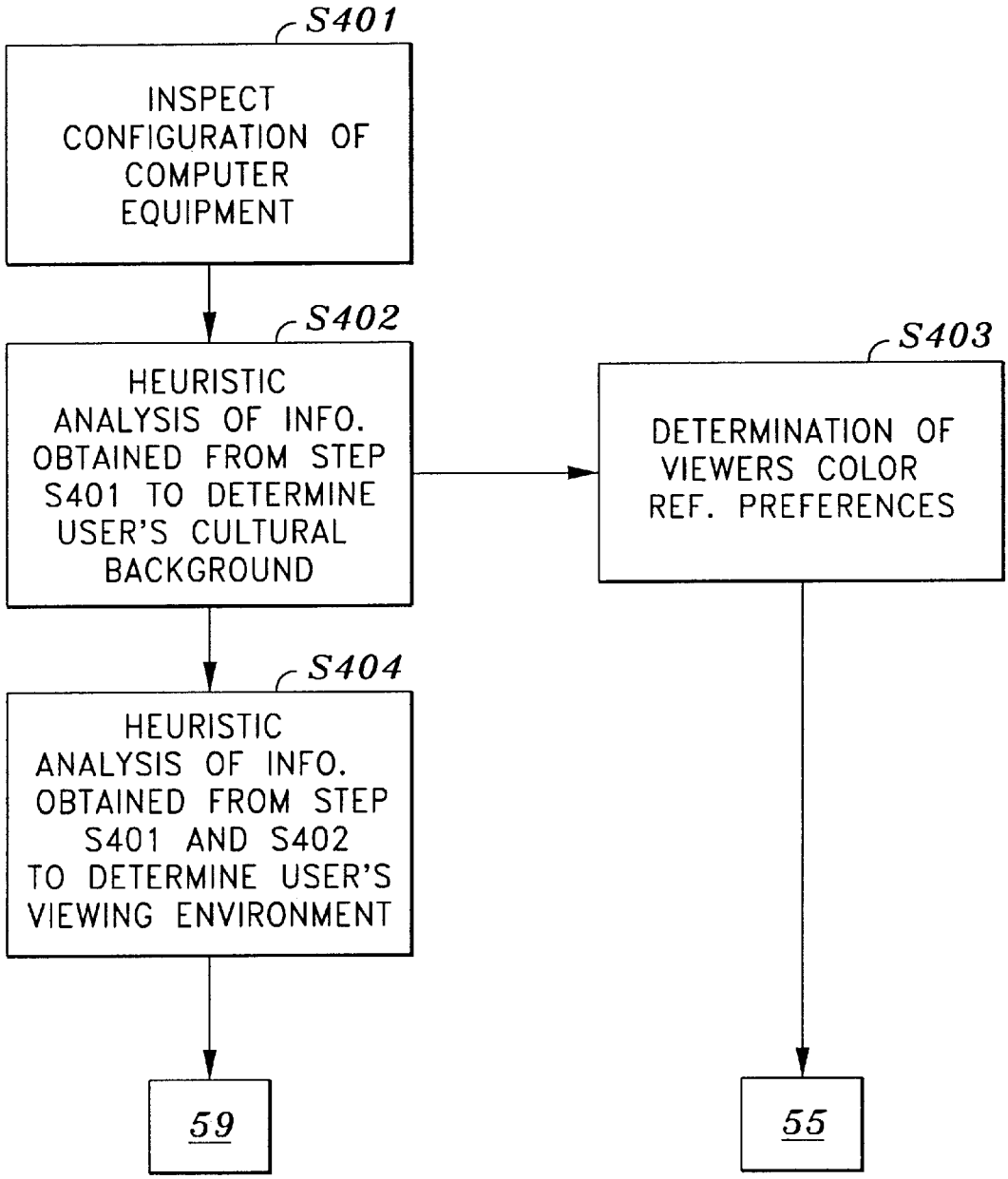
FIG. 4 is a detailed flow diagram explaining use of heuristics to obtain the color environment.
Figure 5:
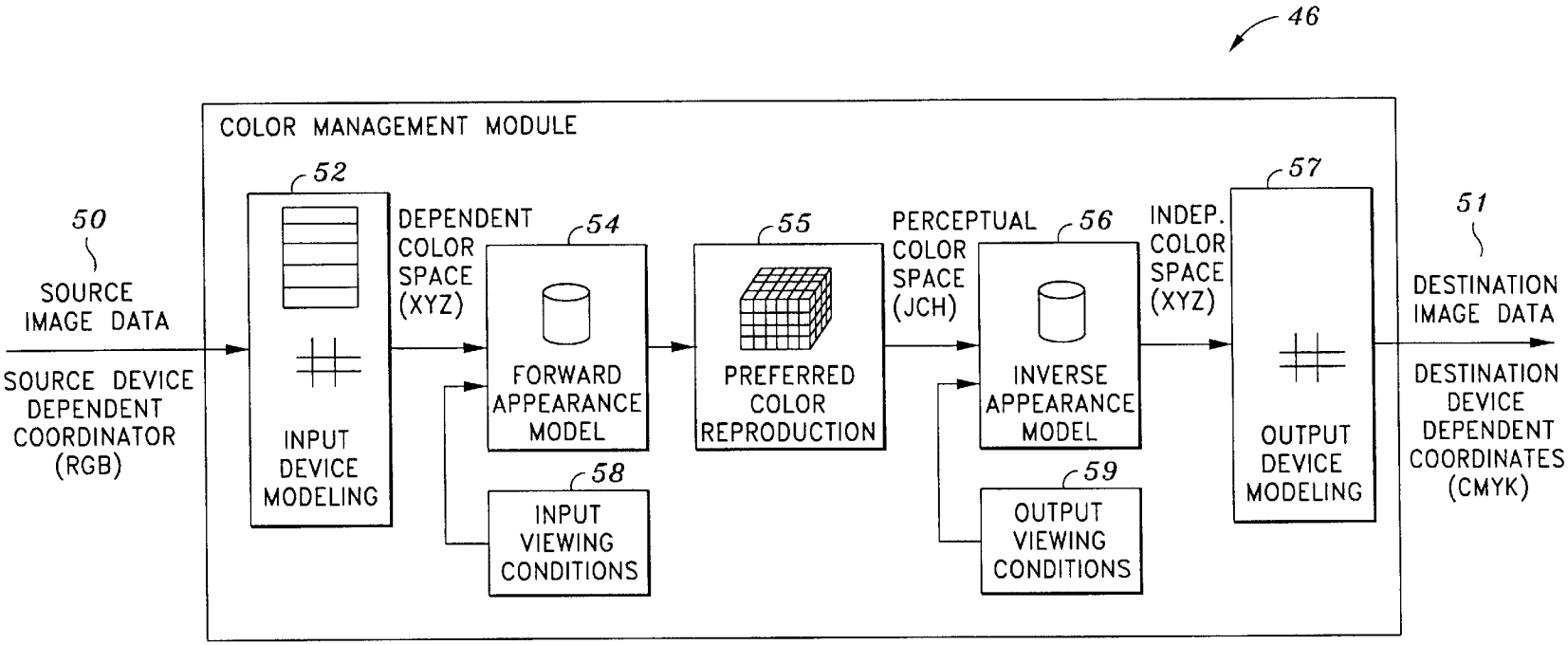
FIG. 5 is a functional block diagram showing a color management according to the invention.

FIG. 4 is a detailed flow diagram explaining use of heuristics to obtain the color environment. Briefly, the process steps shown in FIG. 4 operate to infer the color environment of the user of the computerized image forming device based on heuristic analysis of the configuration of computing equipment 10 used in connection therewith. Color reproduction parameters of the reproduced image are set automatically based on the inferred color environment.

In more detail, step S401 inspects the configuration of the computerized equipment 10 used in connection with the computerized image forming device. The term configuration as used here includes any feature of the computerized equipment 10 that is available for inspection, and includes the type and class of software installed on the computerized equipment 10, language setting of computer user interfaces, time zone settings, installed device drivers for hardware, and other specific information available from particular operating systems of the computerized equipment 10. This information accumulates on the computing equipment 10 through use by the user.

As viewer's color reproduction preferences depend on the viewer's cultural background, information obtained from Step S401 is then heuristically analyzed in Step S402 for clues as to the viewer's cultural background. The user's cultural background is inferred in step S402 from information obtained in step S401 such as the language setting of the user interface of the computing equipment 10 and languages of the software installed on the computing equipment 10. For example, users who prefer their user interface to operate in Japanese are likely to come from a Japanese background. Also, information about the time zone setting of the computing equipment 10 is helpful in inferring the user's cultural background. Computers are typically time-zone-specific and usually connected to a server with a set time zone, which places all user and resource accounts on that server in the same time zone. Inspection of computing equipment 10 as to its time zone setting will provide a clue as to the viewer's locale and therefore the viewer's cultural background.

Determining the user's cultural background based on the user's locale is easier when an internationalized operating system is used on the computer equipment 10. Such systems often provide an Application Program Interface ("API") to determine the country which a user is in. This can be used to select a language for user interface messages, the keyboard translation, setting of the time zones and other information.

In preferred embodiments, the user's color environment also includes the viewing environment of the reproduced image, i.e., the conditions under which the reproduced image will be viewed. As with the cultural background information, non-technical users are unlikely to manually enter information about the environment in which the output image will be viewed into the computing equipment 10. They are, however, likely to install software that is specifically tailored to their intended viewing environment of the reproduced image. For example, those who would view an image in a graphic arts environment are likely to have graphic arts software installed on their computer. Similarly, those who normally view output images in an office environment are likely to have software directed toward office applications installed.

The viewing environment of the reproduced image is inferred in step S404 through heuristic analysis of the information obtained in step S401 such as type and class of software installed on the computer equipment 10 where color management is performed, price of printer 24, and information about the user's cultural background obtained through step S403.

Results from steps S303 and S304 are used respectively in preferred color reproduction 55 and output viewing conditions 59 of the color management module 46 and entered in inverse appearance model 56 in order to determine the destination image 51.

Typical environments for viewing reproduced images can be roughly divided into three categories: home, office, and graphic arts. Presence of software tailored to any of these environments will indicate the likely viewing environment of the reproduced image. For example, presence of professional graphic arts software such as Adobe Illustrator is likely indicative that the image is intended for graphic arts reproduction. Presence of typical office suite software such as Microsoft Office means that the intended viewing environment is probably an office. In cases where no determination can be made as to the intended viewing environment, then a home viewing environment can be assumed.

Inferences concerning the viewing environment will, in turn, provide information as to the typical lighting condition for those environments and therefore the lighting condition under which the reproduced image will likely be viewed. Each of the above categories of viewing environments has a different typical lighting condition. For example, in the U.S. home lighting typically has a chromaticity close to CIE illuminant A, office lighting is typically tri-band fluorescent and has a color temperature between 3500K and 4100K, and graphic arts use is specified to be under CIE illuminant D50. In other countries, other illuminants are more typical. For example, in Europe graphic artists use D65 instead of D50 for viewing booths. Therefore information about the user's locale, determined in step S402, together with the viewing information obtained in step S403 can help infer the viewing environment of the reproduced image.

The technique used to determine the presence of application software would differ depending on the operating system. Microsoft operating systems have a central software registry. Applications add keys to the registry when they are installed. For example, if the registry has a key for Adobe Illustrator, then Illustrator is installed on that system. On Unix and Liunx systems, it is possible to use PATH variable to search for the Illustrator executable. For Macintosh computers under operating systems before version X, the applications folder on the default hard drive is inspected for the presence of the applications.

It is ordinarily unnecessary to compute the color preferences of the viewer and the viewing environment of the reproduced image every time the color management system was used. The default language selection is typically not changed for a given user. Similarly, once a user has configured a system, the installed applications do not change frequently. These could be checked periodically during idle times and updated as needed. The manual override feature of a preferred embodiment is meant to accommodate users that have a different color environment than that which is heuristically determined, or who may not be otherwise satisfied with the heuristically derived color reproduction parameters.

FIG. 5 is a functional block diagram for explaining color management module 46 used in a preferred embodiments. Briefly, information about the viewer's color reproduction preferences, obtained through step S403, and information about the likely viewing environment of the reproduced image, obtained through step S304, are utilized in the color management module 46 of a preferred embodiment in order to optimize color reproduction of the reproduced image. As shown in FIG. 5, source image data 50 is provided to color management module 46 which processes the source image data 50 so as to generate destination image data 51 that incorporates the invention's preferred color image reproduction.

In more detail as to color management module 46, source image data 50 is image data in source device coordinates, such as RGB image data from scanner 22 or digital camera or digital video camera 23. Destination image data 51 is image data in destination device coordinates, such as CMYK coordinates for printer 24. Source image data 50 is converted via a source device transform at forward transform 52, so as to yield image data in a viewing condition independent color space such as CIEXYZ or CIEL*a*b* space. In a preferred embodiment a set of three (3) one dimensional lookup tables and a 3×3 matrix multiply are used to transform the source image data 50 into CIEXYZ space. The transformed image data is converted with an appearance model 54 so as to obtain image data in a perceptual color space such as CIECAM Jch color space shown in a preferred embodiment, or other perceptual color space. Information about the conditions under which the source image 50 is likely to be viewed 58 are input at this stage. While in the perceptual color space, the image data is subjected to color mapping, and in particular is subjected to preferred color image reproduction according to the invention at 55. In a preferred embodiment this step is implemented with a color lookup table that maps source color appearance values to a desired output appearance.

The reproduced image is converted to destination device dependent coordinates. This process starts by subjecting the transformed image to an inverse appearance model 56 so as to yield image data in a device independent color space. Information about the conditions under which the output image is likely to be viewed 59 are input at this stage. In a preferred embodiment the device independent color space is a CIEXYZ space. This image data is thereafter transformed with an inverse device transform 57 for the destination device, so as to yield image data in destination device dependent coordinates such as CMYK coordinates.

The invention has been described with respect to particular illustrative embodiments. It is to be understood that the invention is not limited to the above-described embodiments and that various changes and modifications may be made by those of ordinary skill in the art without departing from the spirit and scope of the invention.

What is claimed is:

1. Color reproduction method in a computerized image forming apparatus comprising:

performing heuristic analysis of the configuration of language settings of the apparatus to infer a color environment of the apparatus;

automatically setting color reproduction parameters of the inferred computerized image forming apparatus based on the color environment of the apparatus, as inferred from the language settings of the apparatus.

2. The method defined in claim 1, wherein the color environment includes color reproduction preferences.

3. The method defined in claim 2, wherein the color reproduction preferences are determined based on the user's cultural background.

4. The method defined in claim 2, wherein the color reproduction preferences are implemented through reference to a color lookup table.

5. The method defined in claim 1, wherein the color environment includes the viewing condition of the reproduced image.

6. The method defined in claim 5, wherein the viewing condition of the reproduced image includes lighting condition under which the reproduced image will be viewed.

7. The method defined in claim 6, wherein the lighting condition are those typically found in graphic arts environment.

8. The method defined in claim 6, wherein the lighting condition are those typically found in an office environment.

9. The method defined in claim 6, wherein the lighting condition are those typically found in a home environment.

10. The method defined in claim 1, wherein the user has the option of overriding the heuristically determined color reproduction parameters by manually entering those parameters through a user interface.

11. The method defined in claim 1, wherein the language setting provides information as to the likely cultural background of the viewer.

12. Color reproduction method in a computerized image forming apparatus comprising:

performing heuristic analysis of the configuration of time zone settings of the apparatus to infer a color environment of the apparatus;

automatically setting color reproduction parameters of the computerized image forming apparatus based on the inferred color environment of the apparatus, as inferred from the time zone settings of the apparatus.

13. The method defined in claim 12, wherein the time zone setting of the computer used in connection with the apparatus provides information as to the likely cultural background of the viewer.

14. Color reproduction method in a computerized image forming apparatus comprising:

performing heuristic analysis of the configuration of type and class of software installed on the apparatus to infer a color environment of the apparatus;

automatically setting color reproduction parameters of the computerized image forming apparatus based on the inferred color environment of the apparatus, as inferred from the type and class of software installed on the apparatus.

15. An apparatus for mapping an original image to a preferred color reproduction of said image using at least one of plural different mapping algorithms, comprising:

a program memory for storing process steps executable to perform a method according to any of claims 1–10, 12 or 14.

16. Computer-executable process steps stored on a computer readable medium, said computer executable process steps for mapping an original image to a preferred color reproduction of said image using at least one of plural different mapping algorithms, said computer-executable process steps executable to perform a method according to any of claims 1–10, 12 or 14.

17. A computer-readable medium which stores computer-executable process steps, the computer executable process steps for mapping an original image to a preferred color reproduction of said image using at least one of plural different gamut mapping algorithms, said computer-executable process steps executable to perform a method according to any of claims 1–10, 12 or 14.

18. A color management module comprising:

a first transformation sequence that transforms color image data to a device-independent color space;

a preferred color image reproduction module that maps colors in the device-independent color space to a preferred color reproduction of said image;

a second transformation sequence that transforms said preferred color image reproduction to device-dependent color space coordinates for the color output device;

wherein said preferred color reproduction module reproduces color in accordance with any of claims 1–10, 12 or 14.

19. A color management module according to claim 18, wherein the color management module is comprised of a color print driver.

20. A color management module according to claim 18, wherein the color management module is comprised of a stand-alone application program.

21. A color management module according to claim 18, wherein the color management module is comprised of a dynamically linked library.

* * * * *